US005172980A

United States Patent [19]

Provost

[11] Patent Number: 5,172,980

[45] Date of Patent: Dec. 22, 1992

[54] RECLOSABLE BAG HAVING HOOK AND LOOP SEALING STRIPS

[75] Inventor: George A. Provost, Manchester, N.H.

[73] Assignee: Velcro Industries, B.V., Netherlands

[21] Appl. No.: 885,519

[22] Filed: May 19, 1992

[51] Int. Cl.[5] ..... B65D 33/16

[52] U.S. Cl. ..... 383/204; 383/81; 428/43

[58] Field of Search ..... 383/5, 81, 204, 209; 428/43

[56] References Cited

U.S. PATENT DOCUMENTS

| | | | |
|---|---|---|---|
| 1,920,321 | 6/1931 | Rosmait . | |
| 2,934,255 | 8/1955 | McDuffie . | |
| 3,123,479 | 2/1961 | Drutt . | |
| 3,154,239 | 2/1963 | Madsen . | |
| 3,203,621 | 4/1963 | Wright . | |
| 3,321,126 | 9/1965 | Rivman . | |
| 3,557,853 | 1/1971 | Jones . | |
| 3,807,626 | 4/1974 | Goodrich . | |
| 4,241,865 | 12/1980 | Ferrell . | |
| 4,337,889 | 7/1982 | Moertel | 383/81 |
| 4,415,386 | 11/1983 | Ferrell et al. . | |
| 4,567,987 | 2/1986 | Lepisto et al. . | |
| 4,580,683 | 4/1986 | Gochenour . | |
| 4,620,320 | 10/1986 | Sullivan | 383/79 |
| 4,637,063 | 1/1987 | Sullivan | 383/61 |
| 4,756,628 | 7/1988 | Branson | 383/63 |
| 4,758,099 | 7/1988 | Branson | 383/44 |
| 4,796,300 | 1/1989 | Branson | 383/63 |
| 4,824,261 | 4/1989 | Provost | 383/81 |
| 4,863,286 | 9/1989 | Branson | 383/63 |
| 4,927,271 | 5/1990 | Branson | 383/5 |
| 4,955,981 | 9/1990 | Provost | 33/86 |
| 4,997,289 | 3/1991 | Sasaki et al. | 383/81 |
| 5,035,517 | 7/1991 | Edelman | 383/61 |

FOREIGN PATENT DOCUMENTS 0446760 9/1991 European Pat. Off. .

*Primary Examiner*—Stephen P. Garbe

*Attorney, Agent, or Firm*—Hayes, Soloway, Hennessey & Hage

[57] ABSTRACT

A reclosable bag has an open end which is closed by a closure strip which can be repeatedly reclosed. The closure strip preferably comprises a hook and loop fastener means which can be brought into engagement and a frangible section running lengthwise of the closure strip. The closure strip is adhesively sealed to the ends of the bag by adhesive sections on opposite sides of the frangible section. In one preferred embodiment of the invention, any opening force applied to the closure by the bag contents places the hook and loop fastener under shear stress only.

8 Claims, 7 Drawing Sheets

RECLOSABLE BAG HAVING HOOK AND LOOP SEALING STRIPS

BACKGROUND OF THE INVENTION

The present invention relates to reclosable bags having hook and loop sealing tapes. Recent developments in such reclosable bags are typified by my earlier U.S. Pat. No. 4,824,261 issued Apr. 25, 1989 and U.S. Pat. No. 4,955,981 issued Sep. 11, 1990. While the developments described in the above patents constitute a considerable advance in the art, they often require the bag producers to modify their bag forming equipment to permit incorporation of the hook and loop tapes at the proper locations in the forming bag. A discussion of recent prior art attempts to solve various problems in conjunction with the production of tamperproof, resealable bags is contained in the above referenced earlier patents, the disclosures of which are incorporated herein by reference.

BRIEF SUMMARY OF THE INVENTION

The present invention has the particular advantage that it can be applied to the open end of a formed bag by simple heat sealing equipment in one single pass to provide a closure which cannot be opened without breaking a tell-tale seal but which can be readily reclosed by a hook and loop connection which will retain the bag closed for repeated access to the interior of the bag. This is accomplished by providing a closure strip which, in one single structure, contains: (a) means for sealing to the ends of the outer surfaces of the open end of the bag, preferably by heat sealing, (b) a frangible portion which normally seals the bag but which can be readily broken to release the bag contents, and (c) a pair of mating hook and loop fastener tapes which can be engaged in face to face contact to reseal the bag. In one preferred embodiment of the invention these hook and loop fasteners tapes are normally in engagement when the bag is initially sealed and constitute additional means for closing the open end of the bag.

With this novel arrangement of elements, one single strip can be applied to the end of the bag for providing the resealable closure to the open end of the bag. After sale the readily frangible section can be broken to release the contents and the bag can be resealed using the convenience of the hook and loop fastener tapes.

DETAILED DESCRIPTION OF THE INVENTION

For a detailed understanding of the invention, reference should be had to the above mentioned drawings and the following specification where two preferred forms of the invention are described.

In general, the present invention provides a product that is easy to put on the bag. It does not require a special bag design or special bag closing equipment. It can be applied by either the bag producer or the bag filler. The design is sufficiently robust to allow multiple openings without delamination from the bag and the hook and loop fastener tapes are not the prime bag closing mechanism. Until the consumer opens the bag there is a secure closure that can be designed to meet any required industry standards.

In the attached drawings there are two preferred design concepts. Both these concepts preferably attach the hook and loop tapes to a carrier strip by means of hot melt adhesive. Both tapes are secured over their entire back surface which reduces the possibility of bond failure during usage.

Figure 1:
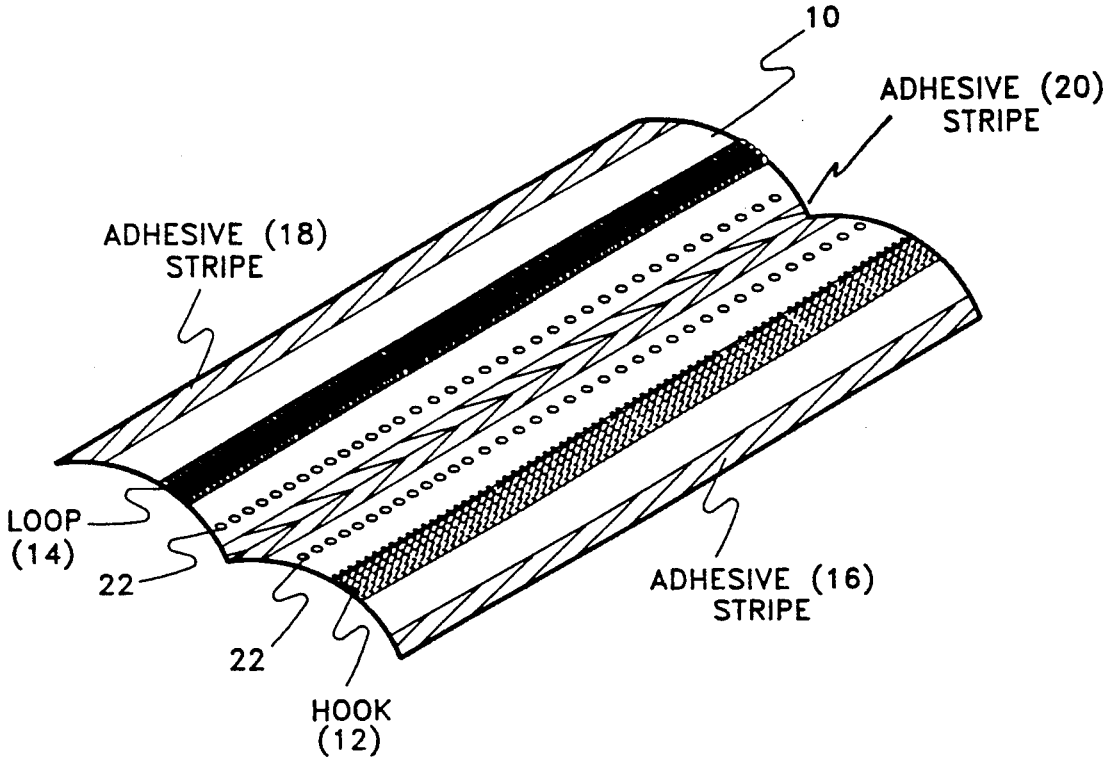
FIG. 1 is an isometric plan view of a closure strip showing one form of the invention.
Figure 2:
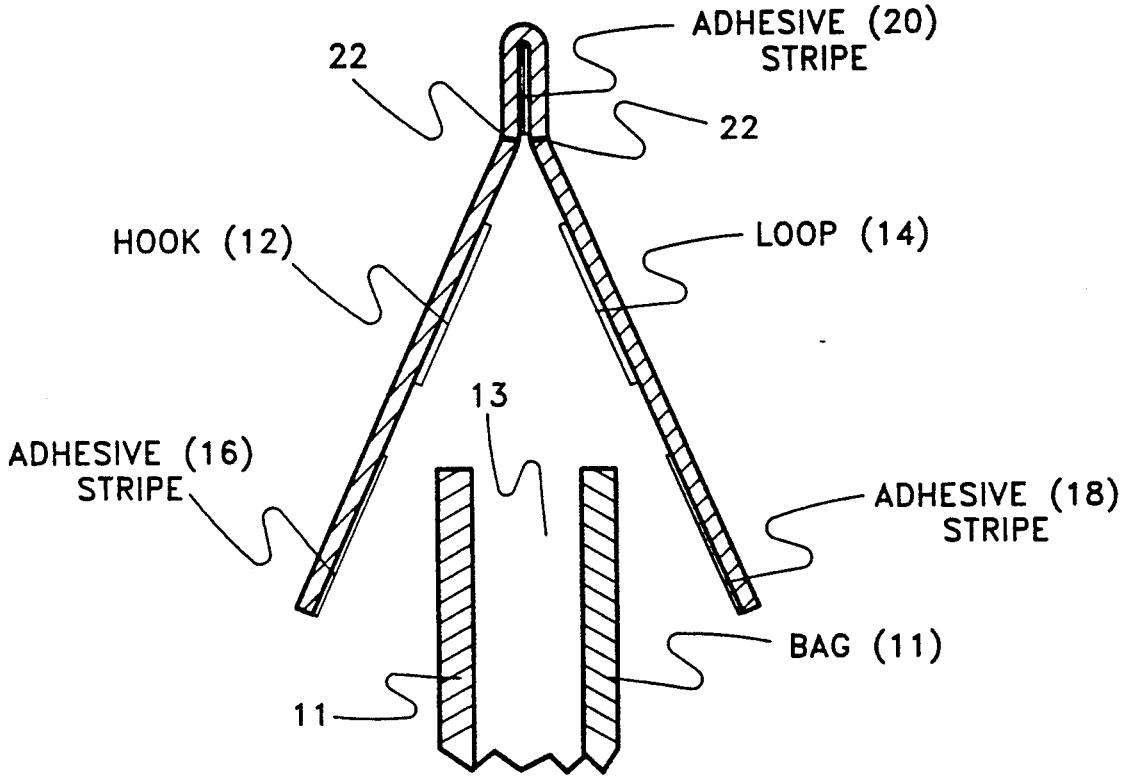
FIG. 2 is a schematic sectional view of the closure strip of FIG. 1 in position to be applied to the open end of a bag.
Figure 3:
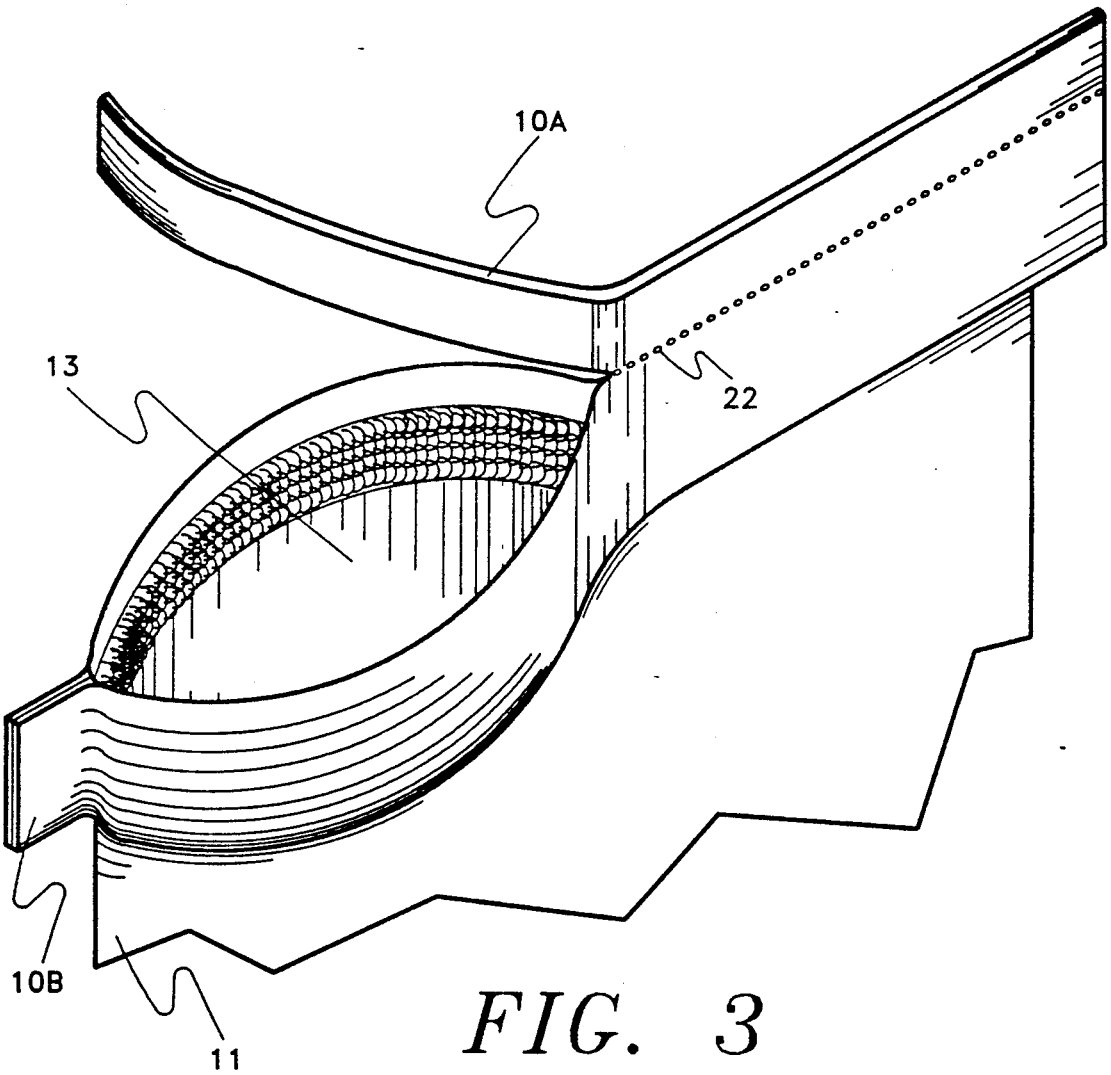
FIG. 3 is a schematic isometric view of a bag sealed by the closure of the invention with a portion of the frangible strip removed to provide access to the bag.

The first design is illustrated in FIGS. 1, 2, and 3 and incorporates a closure strip generally indicated at 10 for sealing the open end 13 of a bag, schematically indicated at 11. In FIG. 1 the closure strip, with its specific parts, is shown in more or less plan view and in FIG. 2 in position to be heat sealed to the open end of the bag. The closure strip 10 has a hook fastener element 12 in the form of an elongated tape and a loop element 14 also in the form of an elongated tape. Both of these tapes run longitudinally of the closure strip 10 and are positioned so that, when the closure strip is run through the heat sealing roll to apply the closure strip and seal it to the open end of the bag, these hook and loop tapes will be pressed into locking engagement. The edges of the closure strip as seen in FIG. 1 contain heat sensitive adhesive stripes 16 and 18 respectively. A heat sealant 20 can be applied at the apex or center of the closure strip. Weakened sections such as perforations 22 are provided between the center of the strip and the two hook and loop fastener tapes 12, 14 to provide a frangible portion 10*a*.

In producing the above bag closure, strip 10 is folded in half and positioned over the bag opening 13 so that the adhesive stripes 16 and 18 on either edge make full contact with the front and back edge of the bag. (see FIG. 2) The bag top is preferably positioned below the hook and loop members 12, 14 and is preferably coincidental with the inner edge of the adhesive stripes 16 and 18. This composite structure is laminated by running it through a suitable heat sealing device which is common to the industry. This will heat reactivate the three adhesive stripes adhering the closure strip 10 to the front and back of the bag 11 and joining the closure strip 10 to itself at the fold line. Typically, this operation is continuous, creating short sections of closure strip material connecting adjacent bags. In these short sections, the closure strip 10 is bonded to itself, not only at the fold, but at its lower edge. The connecting sections are cut at the midpoint between the bags. This creates extending ears which seal shut the sides of the bag 10*b*. The resultant bag closure completely seals the bag such that it only can be opened by tearing the top frangible section of the closure strip at the perforations.

As seen in FIG. 3, when the purchaser desires to open the bag he grasps the frangible portion 10*a* above the perforations 22 and tears it from the end of the bag. Once this section is removed the hook and loop closure can be separated allowing access to the bag contents as schematically illustrated in FIG. 3. The bag can be readily reclosed many times by joining the hook and loop members.

In another preferred embodiment of the invention, the same general principals are employed but an additional fold is provided in the closure strip so that any opening force applied to the closure strip by the contents of the bag, such as when the bag is tipped on its side, will provide an opening force to the hook and loop fasteners which is all in shear. With this type of shear force it is almost impossible for the contents of the bag to inadvertently open the seal provided by the hook and loop fasteners. This design, which is shown in FIGS. 4 through 7, is similar to the previous design but, to accommodate an additional fold to provide for the shear stress on the hook and loop fasteners, one of the adhesive stripes is placed on the back of the closure strip rather than on the front face containing the hook and loop fasteners.

Figure 4:
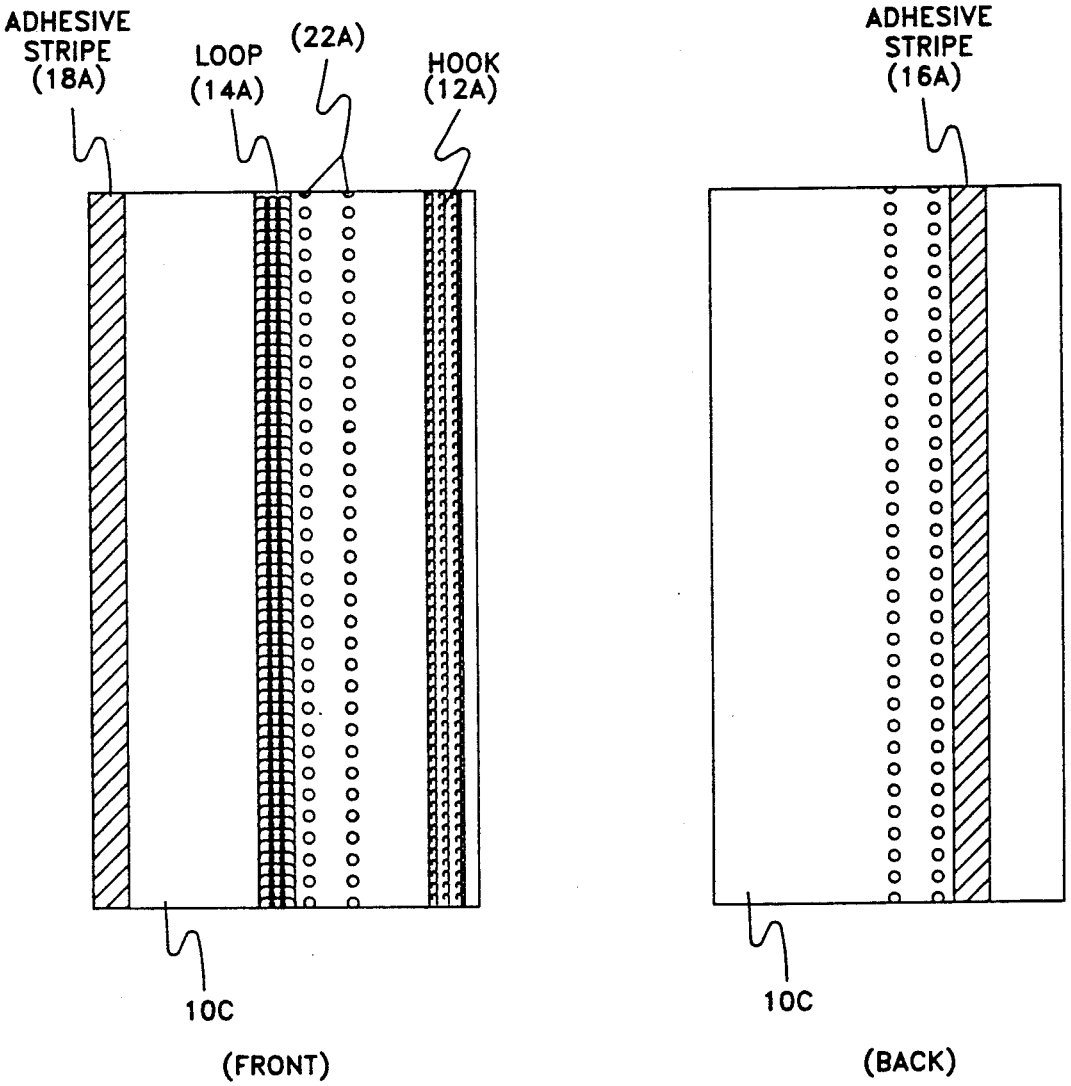
FIG. 4 is a schematic plan view of front and back sides of a closure strip embodying another form of the invention.
Figure 5:
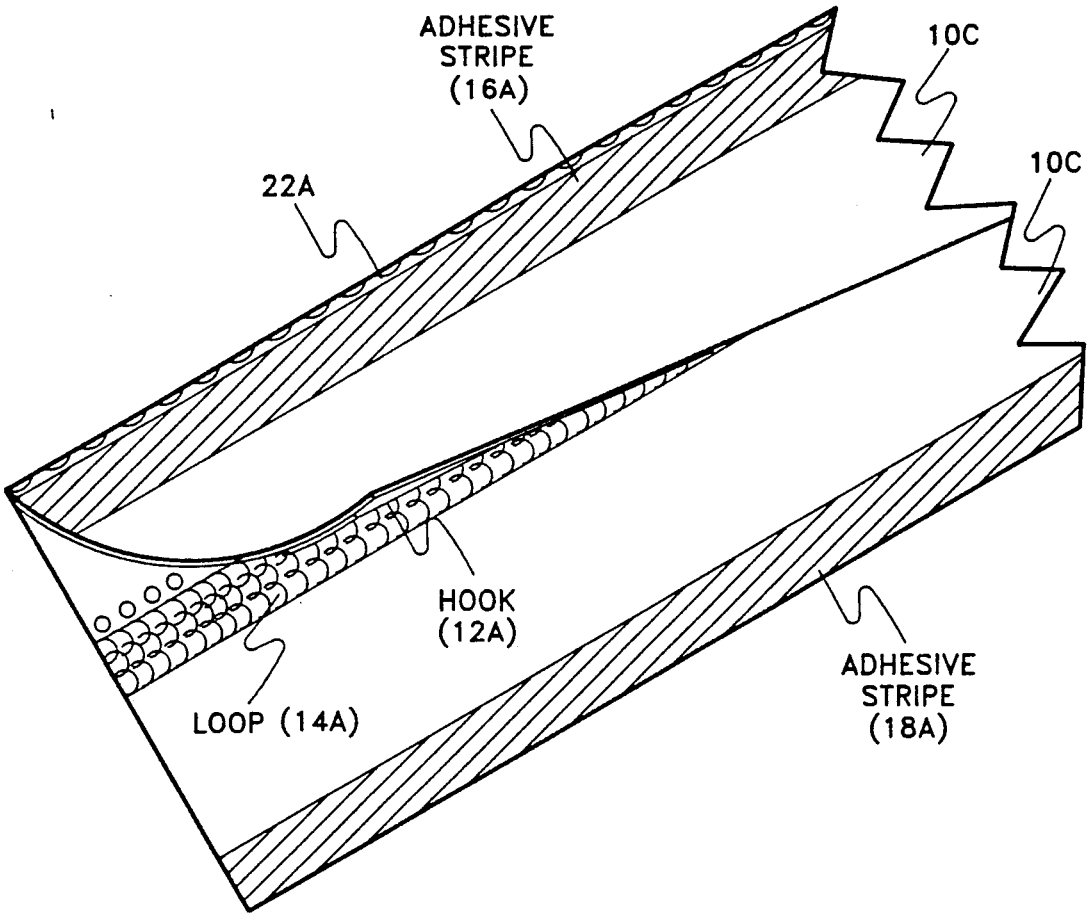
FIG. 5 is a schematic isometric view of the closure strip of FIG. 4 folded longitudinally adjacent the frangible strip.
Figure 6:
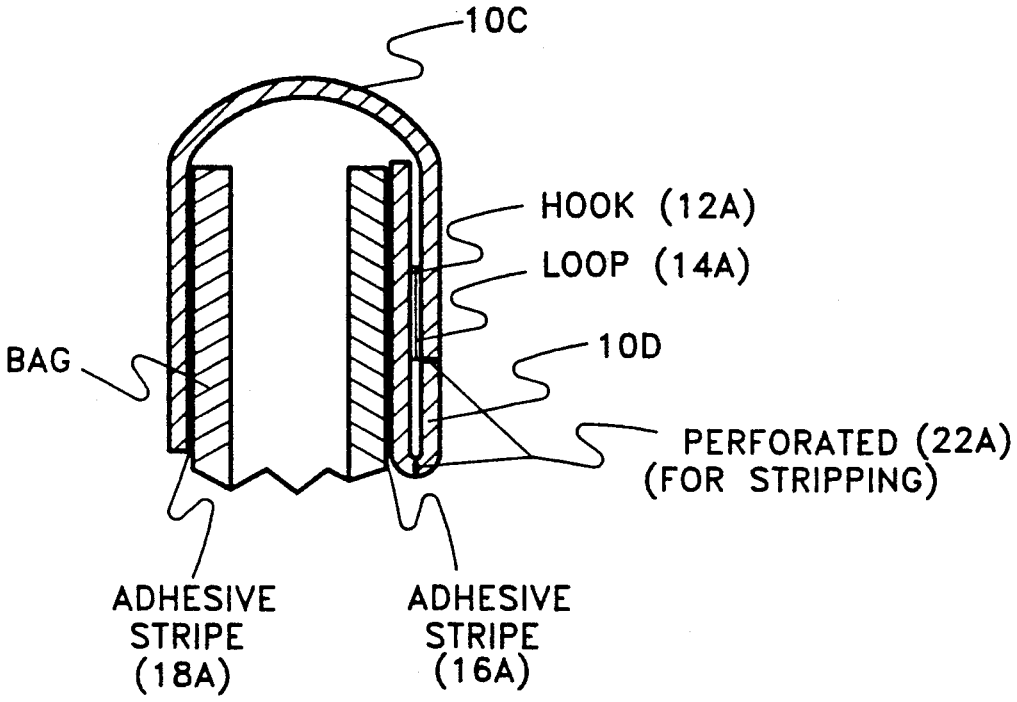
FIG. 6 is a schematic sectional view of the closure strip of FIG. 5 sealed to the end of a bag.
Figure 7:
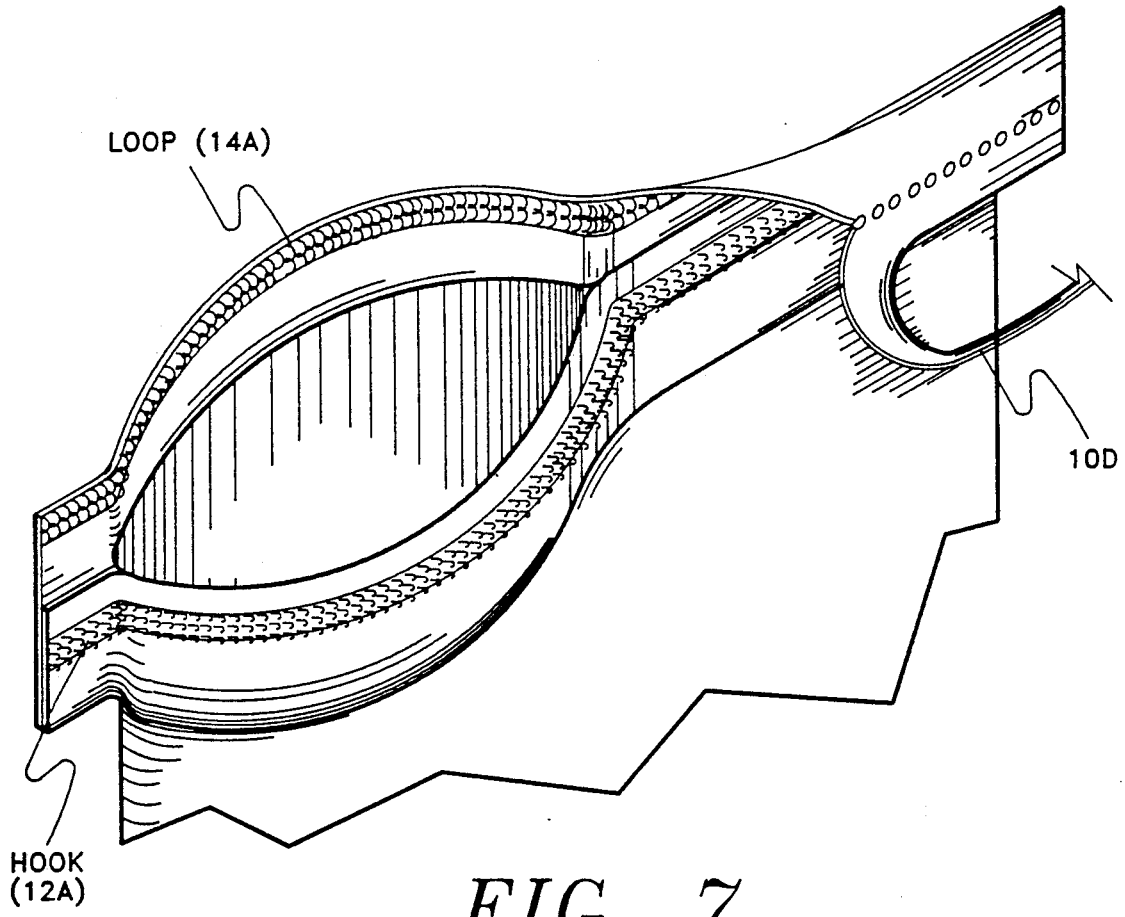
FIG. 7 is a schematic isometric view of a bag sealed as in FIG. 6 with a portion of the frangible strip removed to provide access to the bag interior.

Referring to FIG. 4 where like members refer to like elements the closure strip 10*c* contains the loop tapes 12*a* and the hook tapes 14*a*. One heat sealing stripe 18*a* is on the front of the closure strip and the other adhesive stripe 16*a* is on the back of the strip (see the right hand section of illustration of FIG. 4). When the hook portion of the closure strip is folded over so that it engages the loop stripe, as seen in FIG. 5, the adhesive stripe 16*a* is on the same face as the adhesive stripe 18*a*. This product is then folded again and applied, by a suitable heat sealing mechanism to the open mouth of a bag so that the adhesive stripes secure the closure strip to the open end of the bag. As will be noted the holes 22*a* for a tear strip are between the adhesive stripe 16*a* and the hook and loop fastener. Thus when the frangible section 10*d* is removed the bag is still held closed by the action of the hook and loop fasteners. By grabbing a portion of the severed edge of the closure adjacent the loop fastener the bag closure strip can be peeled open to expose the contents of the bag. This is shown in FIG. 7.

EXAMPLE I

In a preferred embodiment of the invention, the substrate 10 from which the closure is manufactured comprises a poly coated crepe paper such as that sold by Ludlow under the designation 90# crepe with 25# coating. The hook and loop tapes are preferably the type sold by Velcro under the designation Ultra Mate brand HTH 709 and Velcro brand Loop 3610. They are secured to the crepe paper backing by heat activatable adhesive such as that sold by HB Fuller which is applied at a temperature at about 190° C. The two stripes 16 and 18 are preferably HM-1828C adhesive which is applied at a temperature of 190° C. The product of either FIG. 1 or FIG. 4 is preferably manufactured in a continuous coating and laminating equipment utilizing standard hot melt adhesive technology.

While two preferred forms of the invention have been described above wherein standard heat sensitive adhesives have been employed, numerous modifications of the invention can be utilized. While a preferred heat sensitive adhesive is HM-1828C, numerous other types can be utilized. Also, solvent activatable or water activatable adhesives can be employed where they are compatible with the bag manufacturing or sealing machinery.

While the material of the closure tape is preferably heavy paper, it can be modified, as will be well understood in the art, to meet whatever aesthetic or structural requirements are dictated by the particular application. It can be plastic, fabric and the like. Equally, if desired, the frangible portion may be provided with a string or like element for assisting in, or providing the means for, breaking the tamperproof seal.

I claim:

1. A closure strip for resealing a bag opening, comprising a hook fastener means extending longitudinally along one portion of said strip, a loop fastener means extending longitudinally along a second portion of said strip, said two portions being parallel to each other and spaced apart, a frangible section of said strip running lengthwise thereof and spaced parallel to and between said two fastening portions of said strip, at least two adhesive stripes running lengthwise of said strip on opposite sides of said frangible section.

2. A closure strip for resealing a bag opening, comprising a hook fastener means extending longitudinally along one portion of said strip, a loop fastener means extending longitudinally along a second portion of said strip, said two portions being parallel to each other and spaced apart, a frangible section of said strip running lengthwise thereof and spaced parallel to and between said two fastering portions of said strip, at least two adhesive stripes running lengthwise of said strip on opposite sides of said frangible section and adjacent each longitudinal edge of said strip.

3. A reclosable bag having an open end, a closure strip for reclosably sealing said open end, said closure strip comprising a hook fastener means extending longitudinally along one portion of said strip, a loop fastener means extending longitudinally along a second portion of said strip, said two portions being parallel to each other and spaced apart, a frangible section of said strip running lengthwise thereof and spaced parallel to and between said two fastening portions of said trip, at least two adhesive stripes running lengthwise said strip on opposite sides of said frangible section and sealing said closure strip to said open end.

4. The closure strip of claim 1 wherein a first of said adhesive stripes is on a front face of said strip which carries said hook and loop fastener means and a second of said adhesive stripes is on the opposite face of said strip.

5. The closure strip of claim 4 wherein said second adhesive stripe is closer to the centerline of said strip than is one of said fastener means whereby, when said strip is folded longitudinally to bring said two fastener means into face to face contact said second adhesive stripe is positioned adjacent an edge of the folded strip.

6. The closure strip of claim 1 wherein said frangible section of said strip is defined by parallel rows of perforations running along said strip.

7. The bag of claim 3 wherein one adhesive stripe is on the same face of said strip as said hook and loop fastener means and the second adhesive stripe is on the back face of said strip, said hook and loop fasteners being closer to the second adhesive stripe than to the first adhesive stripe so that said strip is folded twice to form said closure whereby said hook and loop fasteners are subjected only to shear forces by contents of the bag.

8. The bag of claim 3 wherein a first of said adhesive stripes is on a front face of said strip which carries said hook and loop fastener means and a second of said adhesive stripes is on the opposite face of said strip, said hook and loop fastener means, when in sealed engagement, being adjacent the outside of the bag open end and below an upper edge of said open end whereby any force tending to open said bag is transmitted to said hook and loop fastener means primarily as a shear force.

* * * * *

UNITED STATES PATENT AND TRADEMARK OFFICE

CERTIFICATE OF CORRECTION

PATENT NO. : 5,172,980

DATED : DECEMBER 22, 1992

INVENTOR(S) : George A. Provost

It is certified that error appears in the above-identified patent and that said Letters Patent is hereby corrected as shown below:

Claim 2, Col. 4, line 31, "fastering" should read --fastening--.

Signed and Sealed this

Nineteenth Day of October, 1993

*Attest:*

Bruce Lehman

BRUCE LEHMAN

*Attesting Officer*

*Commissioner of Patents and Trademarks*